US011731443B2

(12) United States Patent
Miyakoshi

(10) Patent No.: US 11,731,443 B2
(45) Date of Patent: Aug. 22, 2023

(54) INKJET RECORDING APPARATUS

(71) Applicant: KYOCERA Document Solutions Inc., Osaka (JP)

(72) Inventor: Naoto Miyakoshi, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/591,754

(22) Filed: Feb. 3, 2022

(65) Prior Publication Data

US 2022/0258502 A1 Aug. 18, 2022

(30) Foreign Application Priority Data

Feb. 15, 2021 (JP) ..... 2021-022090

(51) Int. Cl.
*B41J 25/316* (2006.01)

(52) U.S. Cl.
CPC ..... *B41J 25/316* (2013.01)

(58) Field of Classification Search
CPC ..... B41J 25/316
See application file for complete search history.

(56) References Cited

U.S. PATENT DOCUMENTS 9,126,445 B1 * 9/2015 Spence ..... B41J 25/34

FOREIGN PATENT DOCUMENTS

JP 2020-121514 8/2020

* cited by examiner

*Primary Examiner* — Scott A Richmond
(74) *Attorney, Agent, or Firm* — Lex IP Meister, PLLC

(57) ABSTRACT

An inkjet recording apparatus includes a recording unit, a head unit, a frame, and an angle adjustment mechanism. The angle adjustment mechanism includes an angle adjustment member, a biasing member, and an operation member. The angle adjustment member is in contact with the head unit and is rotatable about an adjustment rotation shaft extending parallel to the unit rotation shaft of the head unit. The biasing member biases the angle adjustment member in a direction of rotating the angle adjustment member in a first direction. The operation member contacts the angle adjustment member and rotates the angle adjustment member in a second direction opposite to the first direction against a biasing force of the biasing member. The angle adjustment member is configured by of a plurality of shaft members.

7 Claims, 8 Drawing Sheets

INKJET RECORDING APPARATUS

INCORPORATION BY REFERENCE

This application is based upon and claims the benefit of priority from the corresponding Japanese Patent Application No. 2021-022090 filed on Feb. 15, 2021, the entire contents of which are incorporated herein by reference.

BACKGROUND

The present disclosure relates to an inkjet recording apparatus.

An inkjet recording apparatus includes a head unit having a plurality of nozzles that discharge ink, and a recording unit that holds the head unit and records an image on a recording medium such as paper. In order to record the image at a predetermined position on the recording medium, it is necessary to appropriately position the head unit with respect to the recording unit.

A conventional inkjet recording apparatus includes a head assembly having a plurality of nozzle holes for ejecting ink, and an installation part in which the head assembly is installed. The head assembly is rotatable relative to a first longitudinal end part of the installation part. An angle adjustment mechanism is disposed on a second end part side of the installation part opposite to the first end part of the head assembly. The angle adjustment mechanism can adjust the angle of the head assembly with respect to the installation part by pushing the head assembly by rotating an angle adjustment member in contact with the head assembly.

However, in the related art, the angle adjustment member is formed as a single member by a method such as cutting or die casting of a metal material. Accordingly, there is a problem in that the cost of the inkjet recording apparatus increases.

SUMMARY

So as to solve the above-mentioned problems, an inkjet recording apparatus according to the present disclosure includes a recording unit, a head unit, a frame, and an angle adjustment mechanism. The recording unit records an image on a recording medium. The head unit is held by the recording unit and includes a recording head having a plurality of nozzles that discharge ink onto the recording medium. The frame is provided in the recording unit, and the head unit is connected to the frame so as to be rotatable about a unit rotation shaft disposed at one end of the head unit. The angle adjustment mechanism is disposed at another end portion of the frame on a side opposite to the unit rotation shaft, and rotates the head unit around the unit rotation shaft. The angle adjustment mechanism includes an angle adjustment member, a biasing member, and an operation member. The angle adjustment member is in contact with the head unit and is rotatable about an adjustment rotation shaft extending parallel to the unit rotation shaft of the head unit. The biasing member contacts the angle adjustment member and biases the angle adjustment member in a direction of rotating the angle adjustment member in a first direction. The operation member contacts the angle adjustment member and rotates the angle adjustment member in a second direction opposite to the first direction against a biasing force of the biasing member. The angle adjustment member is configured by a plurality of shaft members.

DETAILED DESCRIPTION

Hereinafter, embodiments of the present disclosure will be described with reference to the drawings. Note that the present disclosure is not limited to the following contents.

Figure 1:
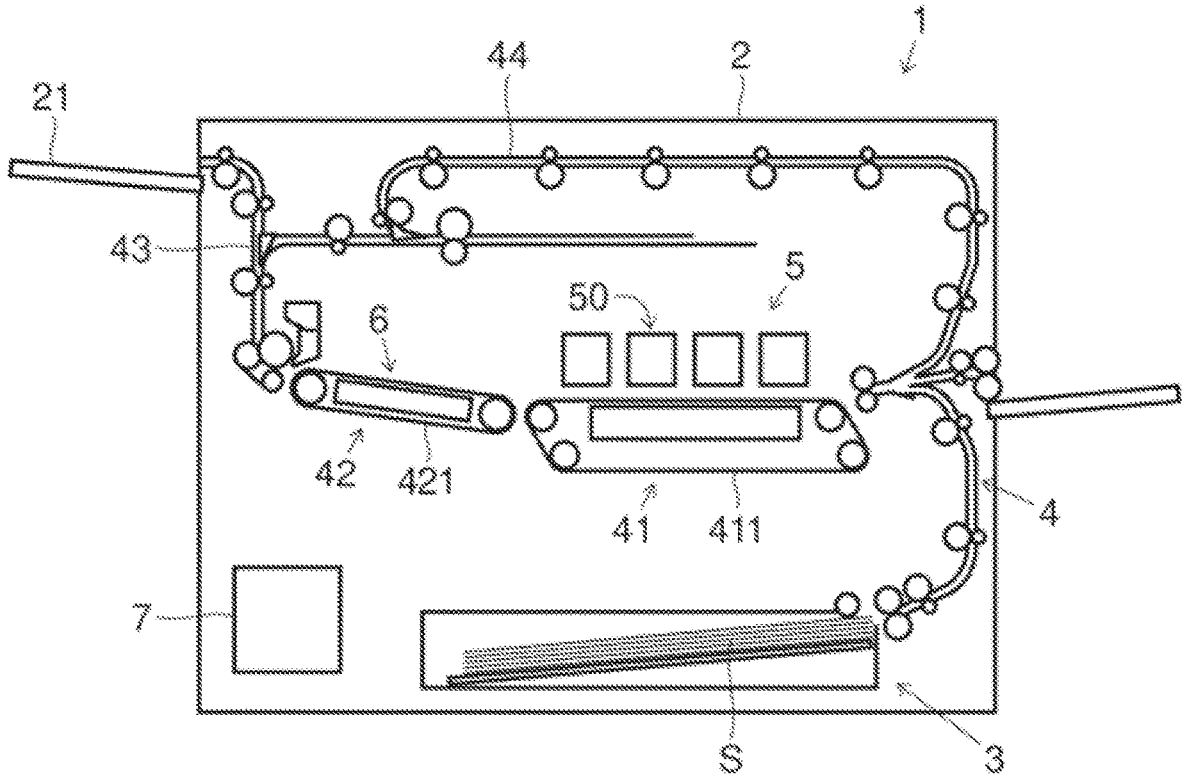
FIG. 1 is a schematic cross-sectional front view of an inkjet recording apparatus according to an embodiment of the present disclosure.
Figure 2:
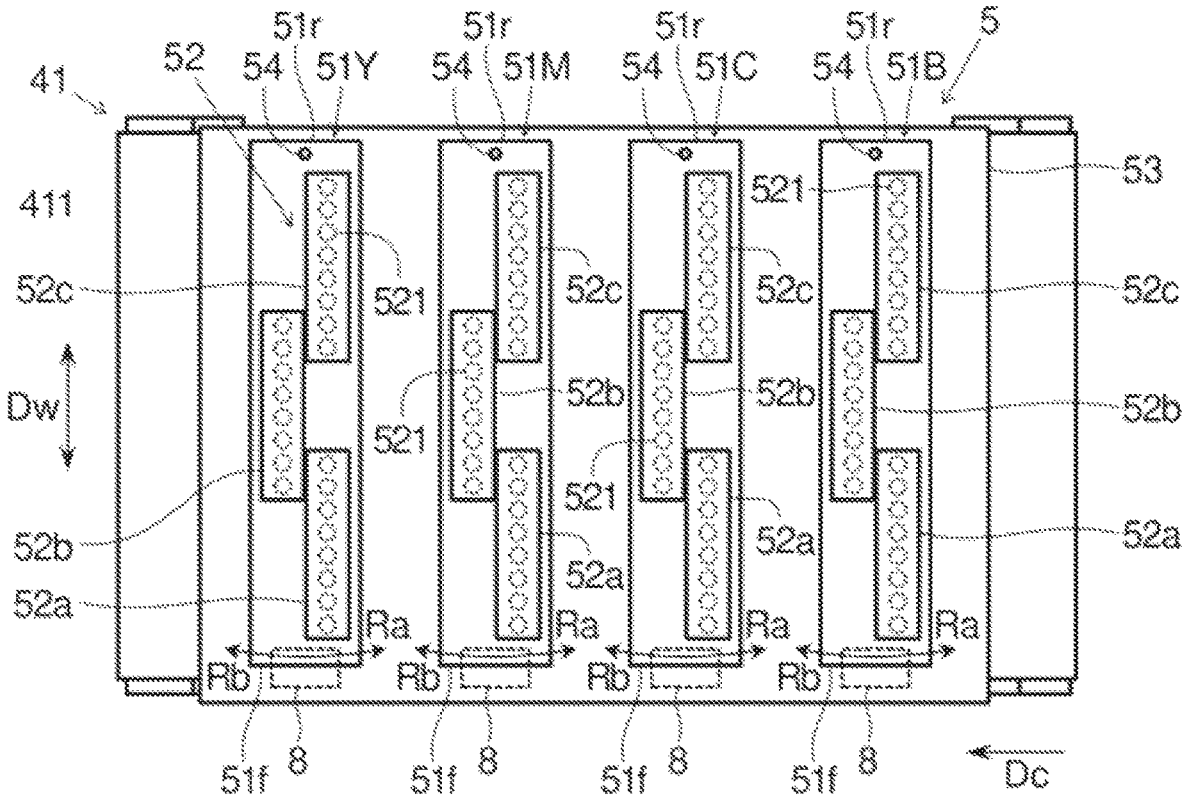
FIG. 2 is a plan view of a recording unit of the inkjet recording apparatus shown in FIG. 1.

FIG. 1 is a schematic cross-sectional view of an inkjet recording apparatus 1 according to an embodiment. FIG. 2 is a plan view of a recording unit 5 of the inkjet recording apparatus 1 shown in FIG. 1. The inkjet recording apparatus 1 is, for example, an inkjet recording-type printer. As shown in FIGS. 1 and 2, the inkjet recording apparatus 1 includes an apparatus main body 2, a sheet supply unit 3, a sheet conveying unit 4, the recording unit 5, a drying unit 6, and a control unit 7.

The sheet supply unit 3 stores a plurality of sheets (recording media) S, and separates and feeds the sheets S one by one at the time of recording. The sheet conveying unit 4 conveys the sheet S fed from the sheet supply unit 3 to the recording unit 5 and the drying unit 6, and further discharges the sheet S after recording and drying to a sheet discharge unit 21. When double-sided recording is performed, the sheet conveying unit 4 distributes the sheet S after recording and drying on the first side to a reverse conveying unit 44 by a branching unit 43, and further switches the conveying direction to convey the sheet S whose front and back are reversed to the recording unit 5 and the drying unit 6 again.

The sheet conveying unit 4 includes a first belt conveying unit 41 and a second belt conveying unit 42. The first belt conveying unit 41 includes an endless first conveying belt 411. The second belt conveying unit 42 includes an endless second conveying belt 421. The first belt conveying unit 41 and the second belt conveying unit 42 convey the sheet S while sucking and holding the sheet S on upper outer surfaces (upper surfaces) of the first conveying belt 411 and the second conveying belt 421, respectively. The first belt conveying unit 41 is disposed below the recording unit 5 and conveys the sheet S. The second belt conveying unit 42 is located downstream of the first belt conveying unit 41 in the sheet conveying direction, and is disposed in the drying unit 6 to convey the sheet S.

The recording unit 5 is disposed above the first conveying belt 411 at a predetermined interval so as to face the sheet S that is conveyed while being sucked and held on the upper surface of the first conveying belt 411. As shown in FIG. 2, the recording unit 5 holds head units 51B, 51C, 51M, 51Y corresponding to four colors of black, cyan, magenta, and yellow. Each of the head units of the respective colors has a recording head 52 of a line type inkjet system. In a head unit of each color, a plurality of recording heads 52 (for example, three (52*a*, 52*b*, 52*c*)) are arranged in a staggered manner along a sheet width direction Dw orthogonal to the sheet conveyance direction Dc.

The recording head 52 has a plurality of ink discharge nozzles 521 at its bottom. The plurality of ink discharge nozzles 521 are arranged side by side along the sheet width direction Dw and can discharge ink over the entire recording area on the sheet S. That is, the recording head 52 has a plurality of ink discharge nozzles 521 that discharge ink onto the sheet S. The recording unit 5 sequentially ejects ink from the recording heads 52 of the four-color head units 51B, 51C, 51M, 51Y toward the sheet S conveyed by the first conveying belt 411, and records a full-color image or a monochrome image on the sheet S.

The drying unit 6 is disposed on the downstream side of the recording unit 5 in the sheet conveyance direction, and the second belt conveying unit 42 is provided. While the sheet S on which the ink image has been recorded by the recording unit 5 is conveyed by being sucked and held by the second conveying belt 421 in the drying unit 6, the ink is dried.

The control unit 7 includes a CPU, a storage unit, and other electronic circuits and electronic components (none of which are shown). Based on control programs and data stored in the storage unit, the CPU controls the operation of each component provided in the inkjet recording apparatus 1 and performs processing related to the functions of the inkjet recording apparatus 1. The sheet supply unit 3, the sheet conveying unit 4, the recording unit 5, and the drying unit 6 individually receive commands from the control unit 7 and perform recording on the sheet S in conjunction with each other. The storage unit is configured by a combination of a non-volatile storage device such as a program ROM (Read Only Memory) or a data-ROM (not shown) and a volatile storage device such as a RAM (Random Access Memory).

Next, the configuration of the recording unit 5 of the inkjet recording apparatus 1 will be further described with reference to FIG. 2. Since the four head units 51B, 51C, 51M, 51Y have the same basic configuration, the identification symbols of "B", "C", "M", and "Y" representing the respective colors may be omitted in the following description unless it is necessary to particularly limit them.

The recording unit 5 includes a frame 53, a unit rotation shaft 54, and an angle adjustment mechanism 8, in addition to the four head units 51.

The frame 53 holds the four head units 51B, 51C, 51M, 51Y. The head units 51B, 51C, 51M, 51Y are arranged side by side along the sheet conveyance direction Dc such that the longitudinal direction thereof is parallel to the sheet width direction Dw. The frame 53 is formed of, for example, a rectangular parallelepiped box body and accommodates four head units 51B, 51C, 51M, 51Y therein. A lower surface of the frame 53 is opposed to an upper surface of the first conveying belt 411 and has an opening (not shown) for discharging ink onto the sheet S.

The unit rotation shaft 54 is disposed on one end part 51*r* of the head unit 51 in the longitudinal direction (sheet width direction Dw), for example, on the back side end portion of the recording unit 5. The rotation shaft of the unit rotation shaft 54 extends in the vertical direction, which is the normal direction of the upper surface of the first conveying belt 411.

Each of the four head units 51 is connected to the frame 53 so as to be rotatable about a unit rotation shaft 54. Another end part 51*f* of the head unit 51 in the longitudinal direction (sheet width direction Dw) is rotatable about the unit rotation shaft 54 in a rotational direction Ra moving upstream or a rotational direction Rb moving downstream in the sheet conveyance direction Dc.

The angle adjustment mechanism 8 is disposed on the side of the other end portion 51*f* of the head unit 51 opposite to the unit rotation shaft 54, for example, on the end portion on the front surface side of the recording unit 5. The angle adjustment mechanism 8 rotates the head unit 51 about the unit rotation shaft 54 in the rotational direction Ra or the rotational direction Rb. Accordingly, the angle adjustment mechanism 8 can adjust the angle of the head unit 51 with respect to the frame 53 of the recording unit 5, and can appropriately position the head unit 51 with respect to the recording unit 5.

Figure 3:
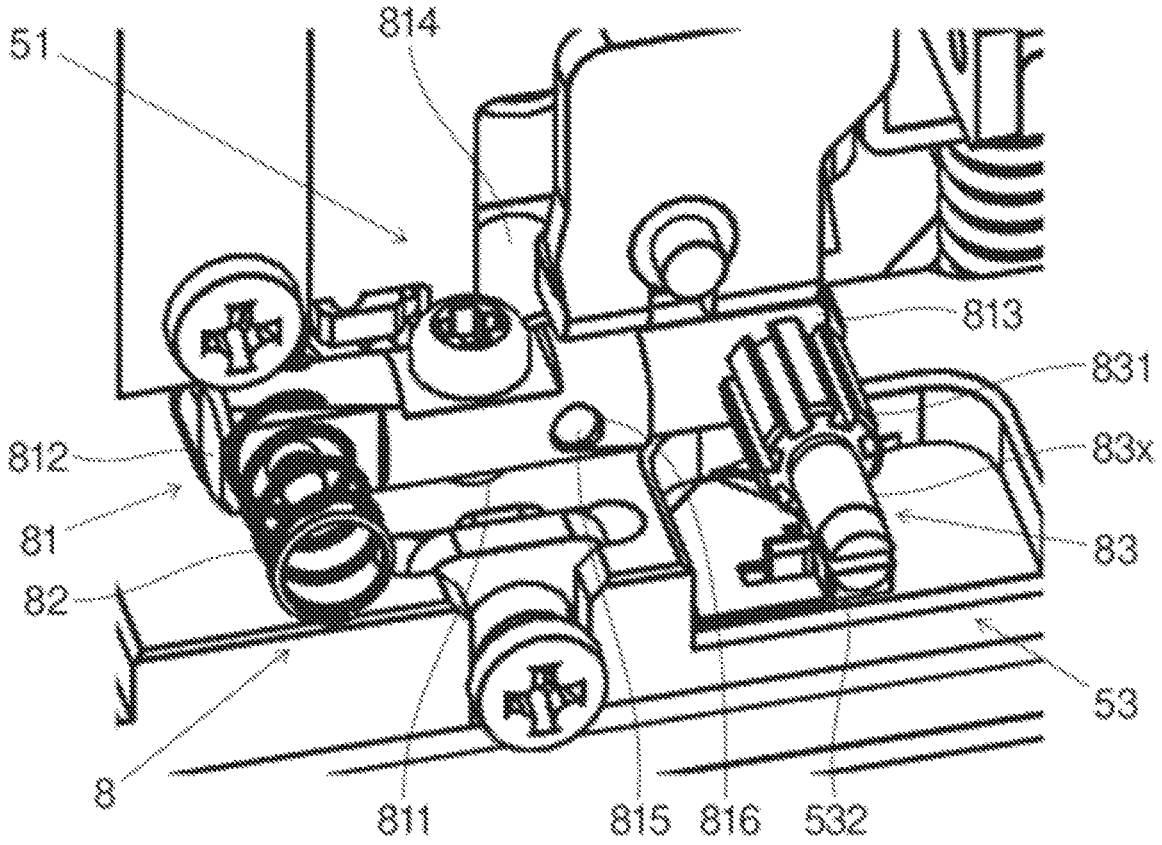
FIG. 3 is a perspective view illustrating the periphery of an angle adjustment mechanism of a recording unit of the inkjet recording apparatus according to the first embodiment of the present disclosure.
Figure 4:
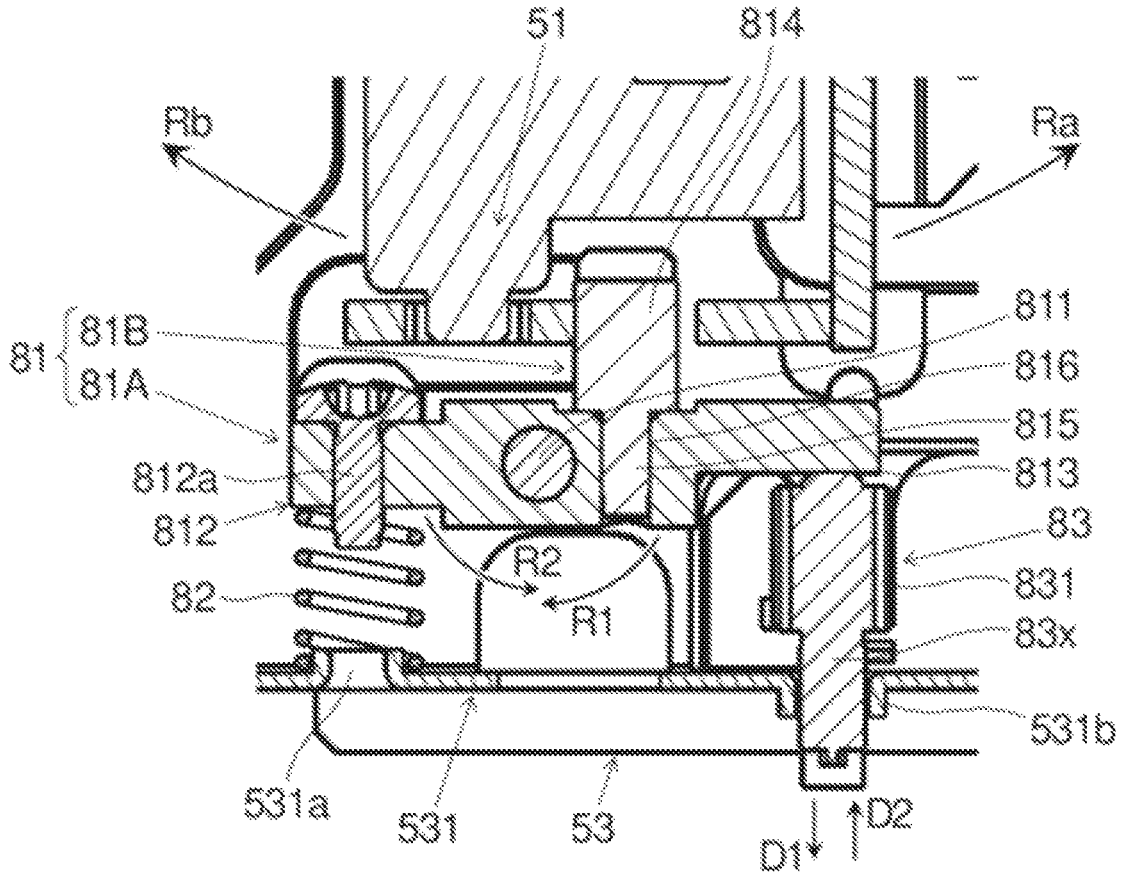
FIG. 4 is a horizontal cross-sectional view around the angle adjustment mechanism shown in FIG. 3.
Figure 5:
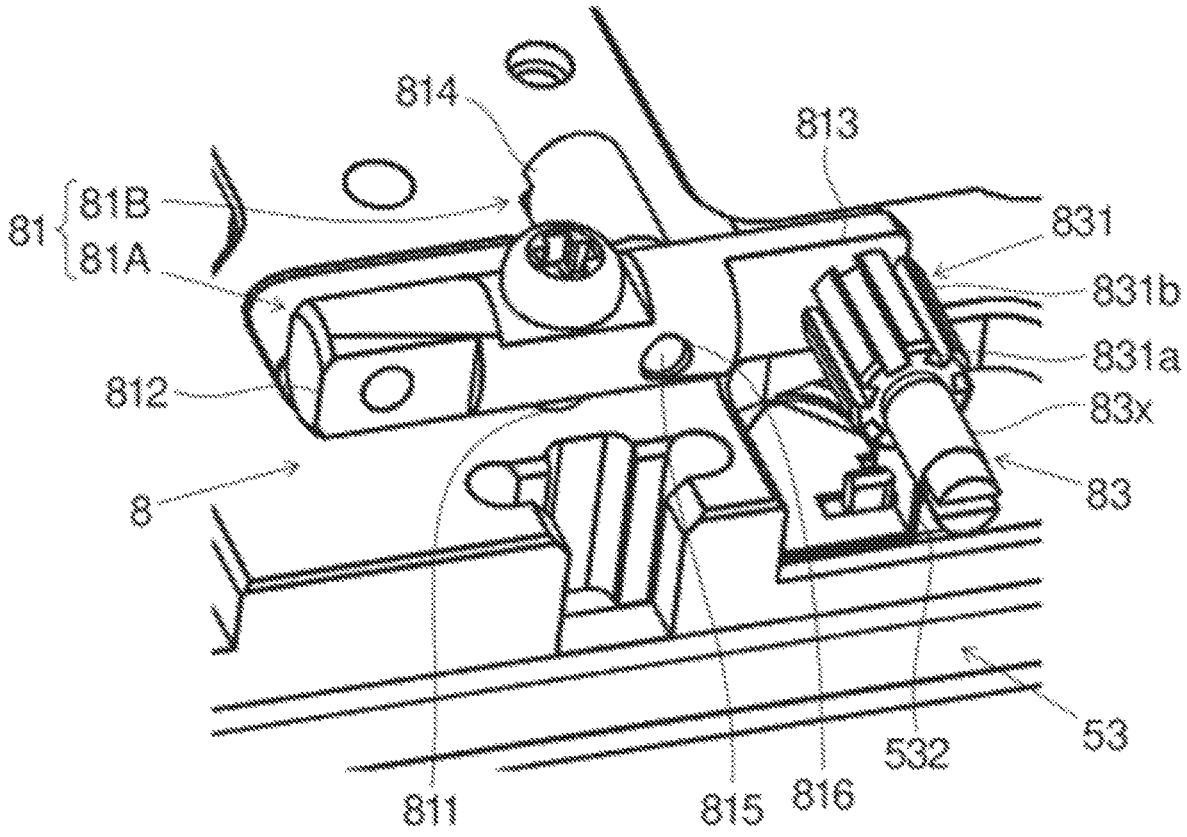
FIG. 5 is a perspective view around an angle adjustment member and an operation member of the angle adjustment mechanism of FIG. 3.
Figure 6:
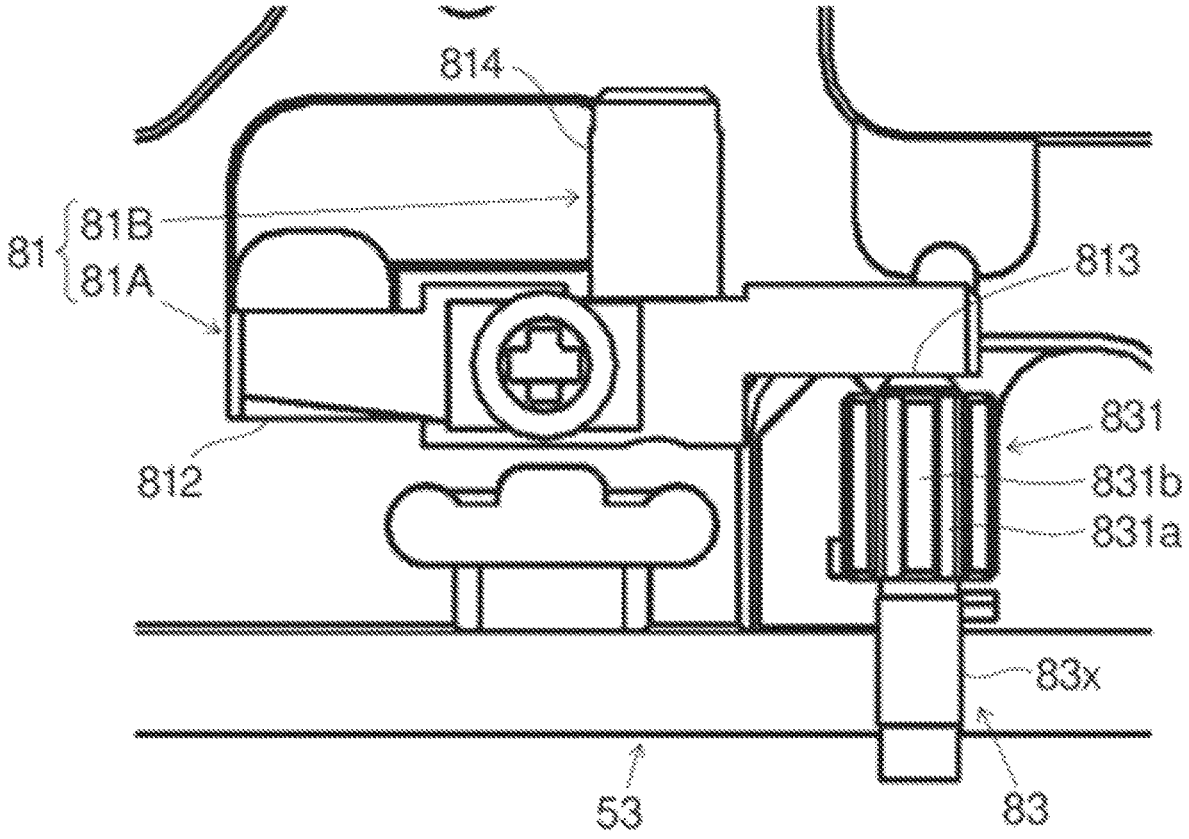
FIG. 6 is a plan view around the angle adjustment member and the operation member shown in FIG. 3.
Figure 7:
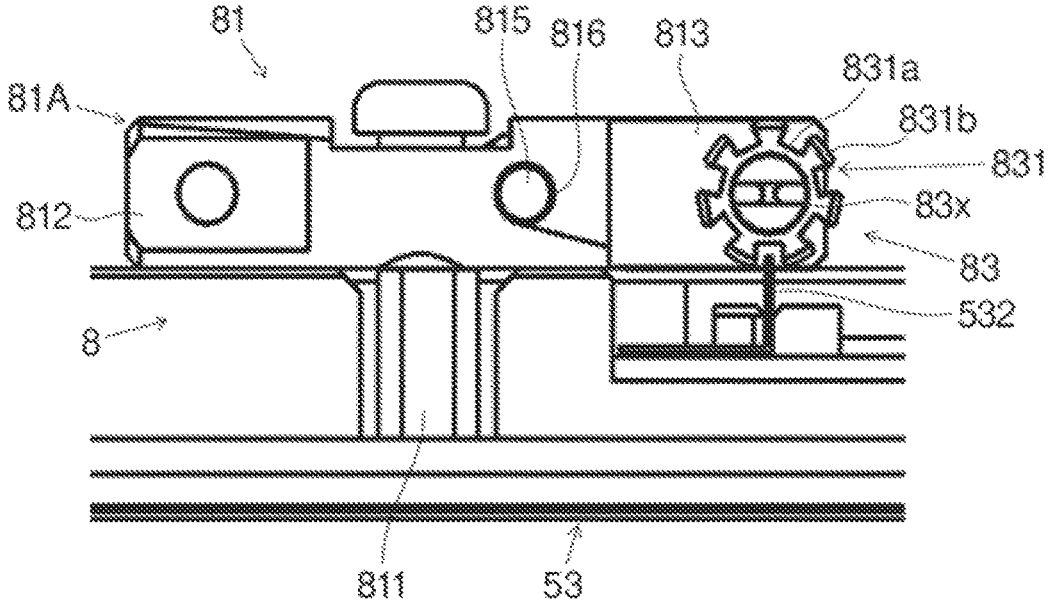
FIG. 7 is a front view around the angle adjustment member and the operation member shown in FIG. 3.

Next, the configuration of the angle adjustment mechanism 8 according to the first embodiment will be described with reference to FIGS. 3 to 7. FIG. 3 is a perspective view illustrating the periphery of the angle adjustment mechanism 8 of the recording unit 5 of the inkjet recording apparatus 1 according to the first embodiment. FIG. 4 is a horizontal cross-sectional view around the angle adjustment mechanism 8 shown in FIG. 3. FIGS. 5, 6, and 7 are a perspective view, a plan view, and a front view around the angle adjustment member 81 and the operation member 83 of the angle adjustment mechanism 8 of FIG. 3.

The angle adjustment mechanism 8 is disposed, for example, on the front side of the recording unit 5, that is, on the front side of the inkjet recording apparatus 1. Thus, the angle adjustment mechanism 8 can be operated from the front side of the inkjet recording apparatus 1. The angle adjustment mechanism 8 includes an angle adjustment member 81, a biasing member 82, and an operation member 83.

The angle adjustment member 81 is disposed close to the front surface of the head unit 51. The angle adjustment member 81 is an elongated member extending in the left-right lateral direction. The angle adjustment member 81 includes an adjustment rotation shaft 811, a biasing contact portion 812, an operation contact portion 813, and a head contact portion 814.

The adjustment rotation shaft 811 is disposed substantially at the center in the longitudinal direction of the angle adjustment member 81. The adjustment rotation shaft 811 extends in the up-down direction parallel to the unit rotation shaft 54. A lower portion of the adjustment rotation shaft 811 is connected to the frame 53. The angle adjustment member 81 is rotatable about the adjustment rotation shaft 811 in a substantially horizontal plane with respect to the frame 53.

The biasing contact portion 812 and the operation contact portion 813 are disposed at both end portions of the angle adjustment member 81 in the longitudinal direction. The biasing member 82 is in contact with the biasing contact portion 812. The operation member 83 is in contact with the operation contact portion 813. The head contact portion 814 is disposed near the center of the angle adjustment member 81 in the longitudinal direction and closer to the operation contact portion 813 than the adjustment rotation shaft 811 is. The head contact portion 814 protrudes toward the head unit 51, that is rearward. The head contact portion 814 of the angle adjustment member 81 comes into contact with the head unit 51.

The biasing member 82 is formed of, for example, a compression coil spring, and is disposed between the biasing contact portion 812 of the angle adjustment member 81 and a front side wall 531 of the frame 53. One end portion of the coil of the biasing member 82 is connected to an inner boss portion 531*a* formed on the front side wall 531 and extending in a direction intersecting with the axial direction of the adjustment rotation shaft 811. The other end portion of the coil of the biasing member 82 is connected to a screw 812*a* inserted into the biasing contact portion 812 and extending in a direction intersecting with the axial direction of the adjustment rotation shaft 811. As a result, the biasing member 82 comes into contact with the angle adjustment member 81. The biasing member 82 biases the angle adjustment member 81 in a direction in which the angle adjustment member 81 is rotated in the first direction R1 (see FIG. 4).

The operation member 83 is configured, for example, in the form of a rotary knob and is rotatably supported on the front side wall 531 of the frame 53. The operation member 83 is configured using, for example, a shaft member, and the rotation shaft thereof extends in a direction intersecting with the axial direction of the adjustment rotation shaft 811. One end portion of the operation member 83 protrudes to the front side of the front side wall 531 and can be rotated. The other end portion of the operation member 83 comes into contact with the operation contact portion 813 of the angle adjustment member 81 from a direction intersecting with the axial direction of the adjustment rotation shaft 811. That is, the operation member 83 contacts the angle adjustment member 81.

A shaft portion 83*x* of the operation member 83 in which a male screw portion is formed on an outer peripheral surface is attached to an outer boss portion 531*x* of the front side wall 531 in which a female screw portion is formed on an inner peripheral surface. When the operation member 83 is rotated about an axis extending in a direction intersecting the axial direction of the adjustment rotation shaft 811, the operation member 83 moves in a direction approaching or separating from the angle adjustment member 81 along the axis. When the operation member 83 is moved in a direction approaching the angle adjustment member 81, the operation member 83 rotates the angle adjustment member 81 in a second direction R2 (see FIG. 4) opposite to the first direction R1 against the biasing force of the biasing member 82.

The head unit 51 is biased by a biasing mechanism (not shown) so as to rotate in the rotational direction Rb in FIG. 4. The head contact portion 814 of the angle adjustment member 81 is disposed at a position facing the biasing force applied to the head unit 51 by the biasing mechanism and is in contact with the head unit 51.

As shown in FIG. 4, when the operation member 83 is rotated and moved in a direction D1 away from the angle adjustment member 81, the head unit 51 is rotated in a rotational direction Ra by a biasing force applied to the head unit 51 by the biasing mechanism (not shown). At this time, the angle adjustment member 81 is rotated in the first direction R1 by the biasing force of the biasing member 82. On the other hand, when the operation member 83 is rotated and moved in the direction D2 approaching the angle adjustment member 81, the angle adjustment member 81 rotates in the second direction R2 against the biasing force applied to the head unit 51 by the biasing mechanism, and the head unit 51 rotates in the rotational direction Rb.

The angle adjustment member 81 is configured by a combination of a plurality of shaft members, that is, a first shaft 81A and a second shaft 81B. According to this configuration, the angle adjustment mechanism 8 can be formed of an inexpensive material. This makes it possible to reduce the cost of the inkjet recording apparatus 1.

The first shaft 81A has a biasing contact portion 812 and an operation contact portion 813 at both ends in the axial direction. That is, the adjustment rotation shaft 811 is provided in the first shaft 81A, and the biasing member 82 and the operation member 83 are in contact with both end portions sandwiching the adjustment rotation shaft 811.

The second shaft 81B has the head contact portion 814 at one end portion in the axial direction and a fastening protrusion 815 connected to the first shaft 81A at the other end portion. That is, the second shaft 81B is fixed to the first shaft 81A and comes into contact with the head unit 51.

The angle adjustment member 81 is configured by a combination of the first shaft 81A having the above-described configuration and the second shaft 81B having the above-described configuration. According to this configuration, the angle adjustment member 81 can be formed by two shaft members. That is, the number of components can be reduced, and the cost of the inkjet recording apparatus 1 can be reduced.

The first shaft 81A has a fastening hole 816. The fastening hole 816 is disposed near the center of the first shaft 81A in the longitudinal direction and closer to the operation contact portion 813 than the adjustment rotation shaft 811 is. The fastening hole 816 extends in a direction intersecting the axial direction of the adjustment rotation shaft 811. A female screw portion is formed on an inner peripheral surface of the fastening hole 816.

The second shaft 81B has a fastening protrusion 815. The fastening protrusion 815 is disposed at an axial end portion of the second shaft 81B. The fastening protrusion 815 extends in a direction intersecting the axial direction of the adjustment rotation shaft 811. A male screw portion is formed on an outer peripheral surface of the fastening protrusion 815.

The fastening protrusion 815 is inserted into the fastening hole 816. As a result, the male screw portion of the fastening protrusion 815 and the female screw portion of the fastening hole 816 mesh with each other, and the second shaft 81B is fixed to the first shaft 81A. According to this configuration, the first shaft 81A and the second shaft 81B can be easily connected and fixed. That is, it is not necessary to separately prepare another member related to connection and fixation of the two shaft members, and it is possible to reduce the number of components.

The operation member 83 includes a positioning portion 831. The positioning portion 831 is formed in a cylindrical shape and located rearward of the front side wall 531. The outer peripheral portion of the positioning portion 831 has a plurality of concave portions 831*a* and a plurality of convex portions 831*b* that are continuous in the circumferential direction. The positioning portion 831 rotates together with the operation member 83. That is, the positioning portion 831 rotates about an axis extending in a direction intersecting the adjustment rotation shaft 811.

The frame 53 includes a protrusion 532. The protrusion 532 is disposed below the positioning portion 831 of the operation member 83 and faces the positioning portion 831. The protrusion 532 protrudes upward toward the positioning portion 831. The protrusion 532 is formed of a sheet-shaped elastic member such as synthetic resin (for example, PET). As the positioning portion 831 rotates, the protrusion 532 sequentially engages with a plurality of concave portion 831*a*.

According to this configuration, when the positioning portion 831 rotates, the protrusion 532 rides on a convex portion 831*b* while being elastically deformed and engages with the concave portion 831*a*. Thus, when the operation member 83 is rotated, a click feeling can be obtained each time the protrusion 532 engages with the concave portion 831*a*. Therefore, operability related to the angle adjustment of the head unit 51 is improved.

Figure 8:
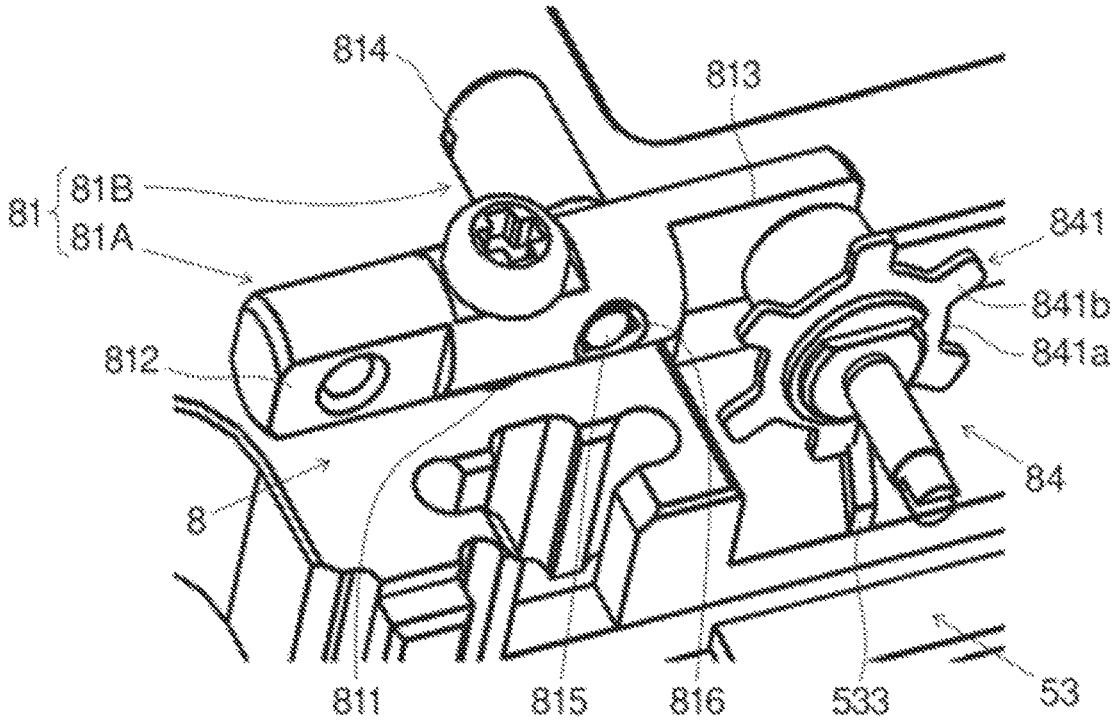
FIG. 8 is a perspective view illustrating the periphery of an angle adjustment mechanism of a recording unit of an inkjet recording apparatus according to a second embodiment of the present disclosure.
Figure 9:
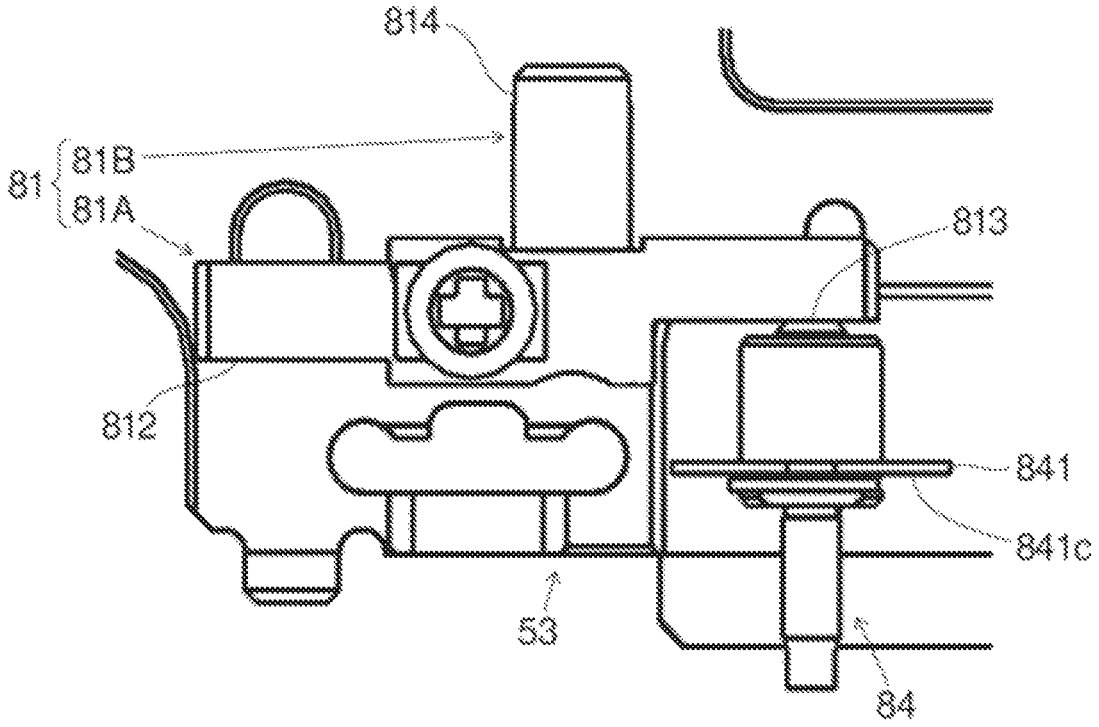
FIG. 9 is a plan view around an angle adjustment member and an operation member shown in FIG. 8.
Figure 10:
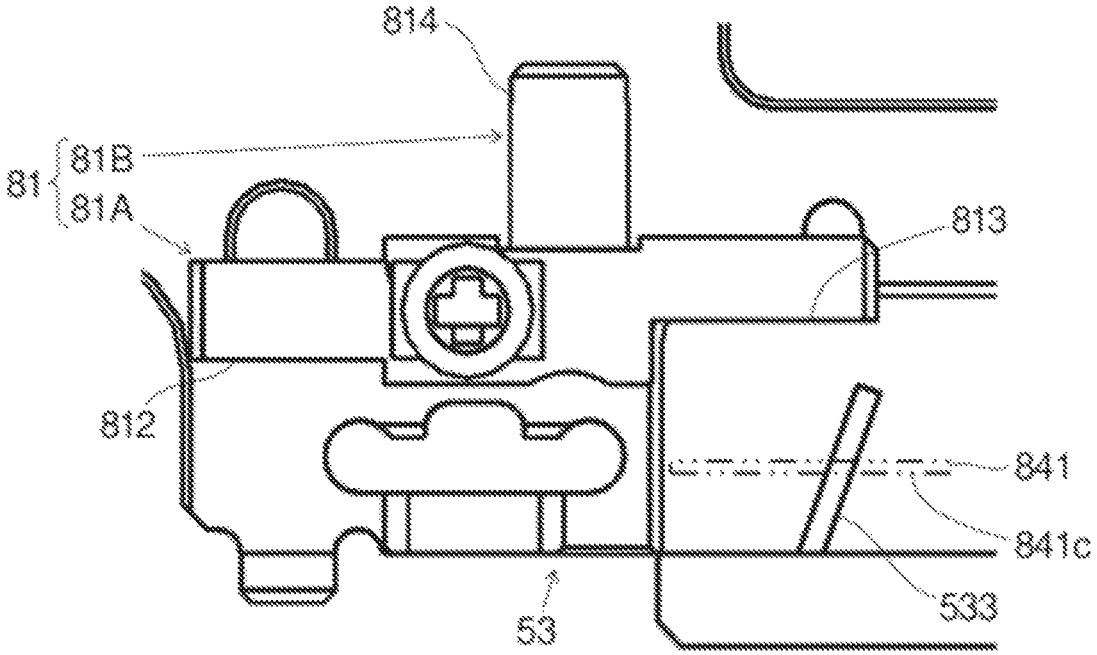
FIG. 10 is a plan view of the periphery of the angle adjustment member of FIG. 8.

Next, a configuration of an angle adjustment mechanism 8 according to a second embodiment will be described with reference to FIGS. 8 to 10. FIG. 8 is a perspective view showing the periphery of the angle adjustment mechanism 8 of the recording unit 5 of the inkjet recording apparatus 1 according to the second embodiment. FIG. 9 is a plan view around the angle adjustment member 81 and the operation member 84 shown in FIG. 8. FIG. 10 is a plan view of the periphery of the angle adjustment member 81 of FIG. 8.

The angle adjustment mechanism 8 includes an operation member 84. The operation member 84 includes a positioning portion 841. The outer peripheral portion of the positioning portion 841 has a plurality of concave portions 841*a* and a plurality of convex portions 841*b* that are continuous in the circumferential direction. The positioning portion 841 is formed of a sheet-shaped elastic member such as a synthetic resin (for example, PET).

The frame 53 includes a protrusion 533. The protrusion 533 is disposed below the positioning portion 841 of the operation member 84 and faces the positioning portion 841. The protrusion 533 protrudes upward toward the positioning portion 841. As the positioning portion 841 rotates, the protrusion 533 sequentially engages with the plurality of concave portions 841*a*. At this time, the convex portion 841*b* of the positioning portion 841 rides on the protrusion 533 while being elastically deformed and engages with the protrusion 533 in the concave portion 841*a*.

As described above, one of the positioning portion and the protrusion may be formed of an elastic member.

As shown in FIG. 10, the protrusion 533 is inclined with respect to a plane of rotation 841*c* (see FIG. 9) of the positioning portion 841. According to this configuration, the positioning portion 841 can be easily elastically deformed. As a result, the load when the operation member 84 is rotated can be reduced, and the operability is improved. Further, the life of the sheet-shaped positioning portion 841 can be extended.

Although the embodiments of the present disclosure have been described above, the scope of the present disclosure is not limited thereto, and various modifications can be made without departing from the spirit of the disclosure.

The present disclosure can be used in an inkjet recording apparatus.

What is claimed is:

1. An inkjet recording apparatus comprising:

a recording unit that records an image on a recording medium;

a head unit that is held by the recording unit and includes a recording head having a plurality of nozzles that discharge ink onto the recording medium;

a frame provided in the recording unit and to which the head unit is connected so as to be rotatable about a unit rotation shaft disposed at one end portion of the head unit; and an angle adjustment mechanism disposed on another end portion of the head unit opposite to the unit rotation shaft and to rotate the head unit about the unit rotation shaft, wherein the angle adjustment mechanism includes:

an angle adjustment member that is in contact with the head unit and is rotatable about an adjustment rotation shaft that extends parallel to the unit rotation shaft;

a biasing member that extends between the frame and the angle adjustment member to be in contact with the frame and the angle adjustment member to bias the angle adjustment member so that the angle adjustment member rotates about the adjustment rotation shaft in a first direction; and an operation member that is operative to come into contact with the angle adjustment member and rotate the angle adjustment member in a second direction opposite to the first direction against a biasing force of the biasing member, and the angle adjustment member is configured by a combination of a plurality of shaft members other than the adjustment rotation shaft, the unit rotation shaft, and the operation member.

2. The inkjet recording apparatus according to claim 1, wherein the angle adjustment member is configured by a first shaft which is rotatable about the adjustment rotation shaft with being in contact with the biasing member and the operation member at both end portions thereof sandwiching the adjustment rotation shaft and a second shaft fixed to the first shaft and in contact with the head unit.

3. The inkjet recording apparatus according to claim 2, wherein the first shaft has a fastening hole in which a female screw portion is formed on an inner circumferential surface thereof, and the second shaft has a fastening protrusion which has a male screw portion formed on an outer circumferential surface thereof and is inserted into the fastening hole.

4. The inkjet recording apparatus according to claim 1, wherein the operation member includes a positioning portion that has a plurality of concave portions and a plurality of convex portions that are continuous in a circumferential direction on an outer peripheral portion thereof and that rotates about an axis extending in a direction intersecting the adjustment rotation shaft, the frame includes a protrusion that sequentially engages with the plurality of concave portions as the positioning portion rotates, and one of the positioning portion and the protrusion is made of an elastic member.

5. The inkjet recording apparatus according to claim 4, wherein the protrusion is inclined with respect to a plane of rotation of the positioning portion.

6. An inkjet recording apparatus comprising:

a recording unit that records an image on a recording medium;

a head unit that is held by the recording unit and includes a recording head having a plurality of nozzles that discharge ink onto the recording medium;

a frame provided in the recording unit and to which the head unit is connected so as to be rotatable about a unit rotation shaft disposed at one end portion of the head unit; and an angle adjustment mechanism disposed on another end portion of the head unit opposite to the unit rotation shaft and to rotate the head unit about the unit rotation shaft, wherein the angle adjustment mechanism includes:

an angle adjustment member that is in contact with the head unit and is rotatable about an adjustment rotation shaft that extends parallel to the unit rotation shaft;

a biasing member that is in contact with the angle adjustment member and biases the angle adjustment member in a direction of rotating the angle adjustment member in a first direction; and an operation member that comes into contact with the angle adjustment member and rotates the angle adjustment member in a second direction opposite to the first direction against a biasing force of the biasing member, the angle adjustment member is configured by a combination of a plurality of shaft members, the angle adjustment member is configured by a combination of a first shaft in which the adjustment rotation shaft is provided and the biasing member and the operation member are in contact with both end portions thereof sandwiching the adjustment rotation shaft and a second shaft fixed to the first shaft and in contact with the head unit, and the first shaft has a fastening hole in which a female screw portion is formed on an inner circumferential surface thereof, and the second shaft has a fastening protrusion which has a male screw portion formed on an outer circumferential surface thereof and is inserted into the fastening hole.

7. An inkjet recording apparatus comprising:

a recording unit that records an image on a recording medium;

a head unit that is held by the recording unit and includes a recording head having a plurality of nozzles that discharge ink onto the recording medium;

a frame provided in the recording unit and to which the head unit is connected so as to be rotatable about a unit rotation shaft disposed at one end portion of the head unit; and an angle adjustment mechanism disposed on another end portion of the head unit opposite to the unit rotation shaft and to rotate the head unit about the unit rotation shaft, wherein the angle adjustment mechanism includes:

an angle adjustment member that is in contact with the head unit and is rotatable about an adjustment rotation shaft that extends parallel to the unit rotation shaft;

a biasing member that is in contact with the angle adjustment member and biases the angle adjustment member in a direction of rotating the angle adjustment member in a first direction; and an operation member that comes into contact with the angle adjustment member and rotates the angle adjustment member in a second direction opposite to the first direction against a biasing force of the biasing member, the angle adjustment member is configured by a combination of a plurality of shaft members, the operation member includes a positioning portion that has a plurality of concave portions and a plurality of convex portions that are continuous in a circumferential direction on an outer peripheral portion thereof and that rotates about an axis extending in a direction intersecting the adjustment rotation shaft, the frame includes a protrusion that sequentially engages with the plurality of concave portions as the positioning portion rotates, and one of the positioning portion and the protrusion is made of an elastic member.

* * * * *